US008574064B2

(12) United States Patent
Gilmore

(10) Patent No.: US 8,574,064 B2
(45) Date of Patent: Nov. 5, 2013

(54) METHOD, APPARATUS, AND PROGRAM PRODUCT FOR DISPLAYING GAMING RESULTS THROUGH VARIABLE PRIZE PROGRESSIONS

(75) Inventor: Jason C. Gilmore, Cedar Park, TX (US)

(73) Assignee: Multimedia Games, Inc., Austin, TX (US)

( * ) Notice: Subject to any disclaimer, the term of this patent is extended or adjusted under 35 U.S.C. 154(b) by 1391 days.

(21) Appl. No.: 12/269,525

(22) Filed: Nov. 12, 2008

(65) Prior Publication Data

US 2009/0124361 A1 May 14, 2009

Related U.S. Application Data

(60) Provisional application No. 60/987,680, filed on Nov. 13, 2007.

(51) Int. Cl.
*A63F 9/24* (2006.01)

(52) U.S. Cl.
USPC ..... 463/25; 463/26; 463/27

(58) Field of Classification Search
USPC ..... 463/30, 32, 16, 20, 25–27
See application file for complete search history.

(56) References Cited

U.S. PATENT DOCUMENTS

| | | | | |
|---|---|---|---|---|
| 6,506,118 | B1 * | 1/2003 | Baerlocher et al. | 463/25 |
| 6,632,141 | B2 * | 10/2003 | Webb et al. | 463/25 |
| 6,692,355 | B2 * | 2/2004 | Baerlocher et al. | 463/16 |
| 7,137,887 | B2 | 11/2006 | Gomez et al. | |
| 7,220,180 | B2 | 5/2007 | Kaminkow et al. | |
| 7,578,739 | B2 * | 8/2009 | Gauselmann | 463/27 |
| 8,460,092 | B1 * | 6/2013 | Slomiany | 463/25 |
| 2003/0045349 | A1 * | 3/2003 | Hughs-Baird | 463/25 |
| 2006/0073874 | A1 * | 4/2006 | Cregan et al. | 463/20 |
| 2006/0079316 | A1 * | 4/2006 | Flemming et al. | 463/25 |
| 2006/0084495 | A1 * | 4/2006 | Jaffe et al. | 463/20 |
| 2008/0039191 | A1 * | 2/2008 | Cuddy | 463/25 |
| 2008/0076535 | A1 * | 3/2008 | Baerlocher et al. | 463/25 |
| 2008/0108410 | A1 * | 5/2008 | Baerlocher | 463/20 |
| 2008/0318668 | A1 * | 12/2008 | Ching et al. | 463/25 |
| 2009/0111566 | A1 * | 4/2009 | Naicker et al. | 463/20 |

OTHER PUBLICATIONS

International Search Report for PCT/US2008/83273 dated Jan. 6, 2009 (2 Pages).

Written Opinion of the International Search Authority (PCT Rule 43bis. 1) for PCT/US2008/83273 dated Jan. 6, 2009 (7 Pages).

* cited by examiner

*Primary Examiner* — Dmitry Suhol
*Assistant Examiner* — Jason Yen
(74) *Attorney, Agent, or Firm* — Russell D. Culbertson, Esq.; JP Cody, Esq.

(57) ABSTRACT

A prize progression graphic displayed at a gaming machine includes a number of prize progressions with each respective prize progression including a respective prize and a respective set of progression segments. The respective prize associated with a prize progression represents a prize that may be won if all of the steps are taken, that is, all of the progression segments for the given prize progression are completed. In addition to displaying the prize progression graphic, a number of player selectable objects are displayed at the gaming machine. In the course of play, a player is enabled to select from among the player selectable objects to reveal prize progression affecting elements. Some prize progression affecting elements cause a corresponding change in progress along of one or more prize progressions, while other such elements modify the prize progressions such as by shifting prizes associated with the prize progressions.

22 Claims, 12 Drawing Sheets

METHOD, APPARATUS, AND PROGRAM PRODUCT FOR DISPLAYING GAMING RESULTS THROUGH VARIABLE PRIZE PROGRESSIONS

CROSS-REFERENCE TO RELATED APPLICATION

The Applicants claim the benefit, under 35 U.S.C. §119(e), of U.S. Provisional Patent Application Ser. No. 60/987,680 filed Nov. 13, 2007, and entitled "Method, Apparatus, and Program Product for Displaying Game Results Through Variable Prize Progressions." The entire content of this provisional application is incorporated herein by this reference.

A portion of the disclosure of this patent document contains material which is subject to copyright protection. The copyright owner has no objection to the facsimile reproduction by any one of the patent documents or the patent disclosure, as it appears in the Patent and Trademark Office patent file or records, but otherwise reserves all rights of copyright.

TECHNICAL FIELD OF THE INVENTION

This invention relates to gaming systems and to gaming machines used to present gaming results. More particularly, the invention relates to methods for displaying gaming results through a player interaction process that provides multiple prize progressions for a player and varies the prize progressions during the course of play.

BACKGROUND OF THE INVENTION

Many different types of gaming machines have been developed to provide various formats and graphic presentations for conducting games and presenting game results. For example, numerous mechanical reel-type gaming machines, also known as slot machines, have been developed with different reel configurations, reel symbols, and paylines. More recently, gaming machines have been developed with video monitors that are used to produce simulations of mechanical spinning reels. These video-based gaming machines may use one or more video monitors to provide a wide variety of graphic effects in addition to simulated spinning reels, and may also provide secondary/bonus games using different reel arrangements or graphics that do not use simulated spinning reels but instead use entirely different graphics to show results. Many video-based gaming machines have three or five spinning reels that may be stopped to display a matrix of game symbols. The symbols displayed on the stopped reels correlate to a result of the game. Video-based gaming machines may also be used to show card games or various types of competitions such as simulated horse races in which wagers may be placed. Game manufacturers are continuously pressed to develop new game presentations, formats, and game graphics in an attempt to provide high entertainment value for players and thereby attract and keep players.

SUMMARY OF THE INVENTION

The present invention includes a highly entertaining method of presenting game results. The entertainment value is achieved by displaying to a player a variable prize progression graphic through which the play may progress during the course of play to ultimately obtain a prize associated with the variable prize progression graphic. The present invention encompasses methods for operating a gaming machine as well as both apparatus and program products for implementing the gaming machine operation methods.

A method embodying principles of the invention may be implemented in a gaming machine using one or more display devices such as CRTs, LCDs, plasma displays, or other types of video display devices. The display device or devices are used to show the variable graphic elements according to the invention. It is also possible to show variable prize progressions according to the present invention using a mechanical display device. As used in this disclosure and the accompanying claims, unless specifically stated otherwise, a gaming machine through which the present invention may be implemented will be referred to generally as a "gaming machine" regardless of the nature of the display device arrangement used to show results to the player.

One preferred method includes displaying a prize progression graphic at a gaming machine. The prize progression graphic includes a number of prize progressions with each respective prize progression including a respective prize and a respective set of progression segments. Although not necessarily displayed as a path, each prize progression may be thought of as a path with each associated progression segment representing a step along that path. The respective prize associated with a prize progression represents a prize that may be won if all of the steps are taken, that is, all of the progression segments for the given prize progression are completed. One aspect of the present invention is that as progress is made along the progression segments of a given prize progression, this progress is apparent, preferably visibly apparent, to the player. Thus, as progress is made along a given prize progression, the player may see or otherwise appreciate the extent of the progress and how close the player is to completing the prize progression and thereby winning the associated prize.

In addition to displaying the prize progression graphic, a preferred method also includes displaying a number of player selectable objects at the gaming machine. These player selectable objects may be referred to herein and in the accompanying claims simply as "objects." Each player selectable object corresponds to, and in some embodiments may conceal, a respective prize progression affecting element. Also, each respective prize progression affecting element may comprise either a progress varying value or a prize shifting value. Once the prize progression graphic and the player selectable objects are displayed, a player is enabled to select a number of the player selectable objects. In response to the player's selection of a respective player selectable object, the method includes, if the respective prize progression is concealed, revealing the respective prize progression affecting element associated with the selected player selectable object. The method further includes modifying the prize progression graphic in a manner that depends upon the respective prize progression affecting element that is revealed. For each selected progress varying value, the prize progression graphic is modified by varying the progress in the respective progression segments for one or more prize progressions. That is, the progress toward the respective prize for one or more prize progressions is modified, either increasing the progress toward the respective prize or conceivably decreasing the progress. For each selected prize shifting value, the prize progression graphic is modified by shifting at least one respective prize from being associated with one prize progression to being associated with a different one of the prize progressions. That is, one or more prizes are moved so that they represent a goal of a different one of the prize progressions.

The player ultimately completes progress along one or more of the prize progressions by virtue of having selected player selectable objects and the modifications to the prize progressions resulting from the selected prize progression affecting elements. Progress is "completed" for a prize progression when the segments toward a prize are covered or otherwise traversed so that the prize included in the prize progression is reached. Some preferred forms of the present invention include awarding to the player the respective prize associated with the first completed prize progression. In some forms of the invention it may be possible to complete multiple prize progressions on a given selection of a player selectable object in which case the method may award multiple prizes, namely the respective prize associated with each completed prize progression. Other forms of the present invention may give the player a set number of selections of player selectable objects and the player is awarded the respective prize for each prize progression that has been completed once the player has made all of his or her selections.

Some forms of the present invention include player selectable objects that correspond to (and perhaps conceal) types of prize progression affecting elements other than progress varying values and prize shifting values. For example, an additional player selectable object may conceal a prize level symbol shifting value. Where such an additional player selectable object is displayed at the gaming machine, one or more of the prize progressions may be associated with a prize level symbol that indicates a value associated with the prize for that prize progression, and one or more of these prize level symbols may include a prize enhancer such as a multiplier value that will apply to multiply the associated prize if that prize progression is completed. In response to the player selection of the additional object corresponding to the prize level symbol shifting value, a method according to the invention includes revealing the prize level symbol shifting value if it is concealed and modifying the prize progression graphic by shifting at least one respective prize level symbol from being associated with one prize progression to being associated with a different one of the prize progressions. That is, a prize level symbol (and any prize enhancer associated with the prize level symbol) that was before the player selection associated with one prize progression would, after application of the prize level symbol shifting value, be associated with a different one of the prize progressions.

A method according to the invention that employs prize level symbols and allows such symbols to be shifted between prize progressions by virtue of player selections of player selectable objects, may include graphic effects associated with the prize level symbols. In particular, some forms of the invention may change the prize level symbols as they are shifted from one prize progression to another by changing a symbolized value indicated by the symbol. For example, a prize level symbol associated with a low value prize may show a low value article, but may be changed to a higher value article if the prize level symbol is shifted to a prize progression associated with a relatively higher value prize. The prize level symbol may be changed back to a lower value article if it is switched back to a prize progression associated with a lower value prize.

An apparatus according to one form of the invention includes a display device arrangement (that may include one or more separate display devices), a player input device, a presentation controller, and an award controller. The presentation controller functions to cause the display arrangement to display a prize progression graphic as discussed above including a number of prize progressions with each respective prize progression being associated with a respective prize and a respective set of progression segments. The presentation controller also functions to cause the display arrangement to display a number of player selectable objects as described above with each object concealing a respective prize progression affecting element. When a player selects a respective player selectable object using the player input device, the presentation controller responds by causing the display arrangement to reveal the respective prize progression affecting element associated with the selected object and to modify the prize progression graphic. In particular, for each selected progress varying value the prize progression graphic is modified by varying the progress in the respective progression segments for one or more prize progressions, and for each selected prize shifting value the prize progression graphic is modified by shifting at least one respective prize from being associated with one prize progression to being associated with another one of the prize progressions. The award controller functions to award to the player the respective prize associated with each prize progression for which progress in the respective progression segments is completed on a given player selection of one of the objects or at or before completion of the selection process.

The invention further encompasses a program product that may be embodied in computer readable media. Such a program product may include prize progression display program code, object display program code, player selection program code, and award program code. The prize progression display program code is executable for causing a gaming machine display arrangement to display the above-described prize progression graphic. The object display program code is executable for causing the display arrangement to display the above-described player selectable objects. The player selection program is code executable for selecting a number of the objects, preferably in response to player inputs entered through some player input arrangement. In response to the selection of a respective player selectable object, the player selection program code causes the display arrangement to reveal the respective prize progression affecting element associated with the selected object (is the prize progression affecting element is concealed) and modify the prize progression graphic accordingly as described above. The award program code is executable to cause the gaming system to award to the player the respective prize associated with each prize progression for which progress in the respective progression segments is completed on a given player selection of one of the player selectable objects or at or before a final selection of some number of player selections.

These and other advantages and features of the invention will be apparent from the following description of the preferred embodiments, considered along with the accompanying drawings.

DESCRIPTION OF PREFERRED EMBODIMENTS

Figure 1:
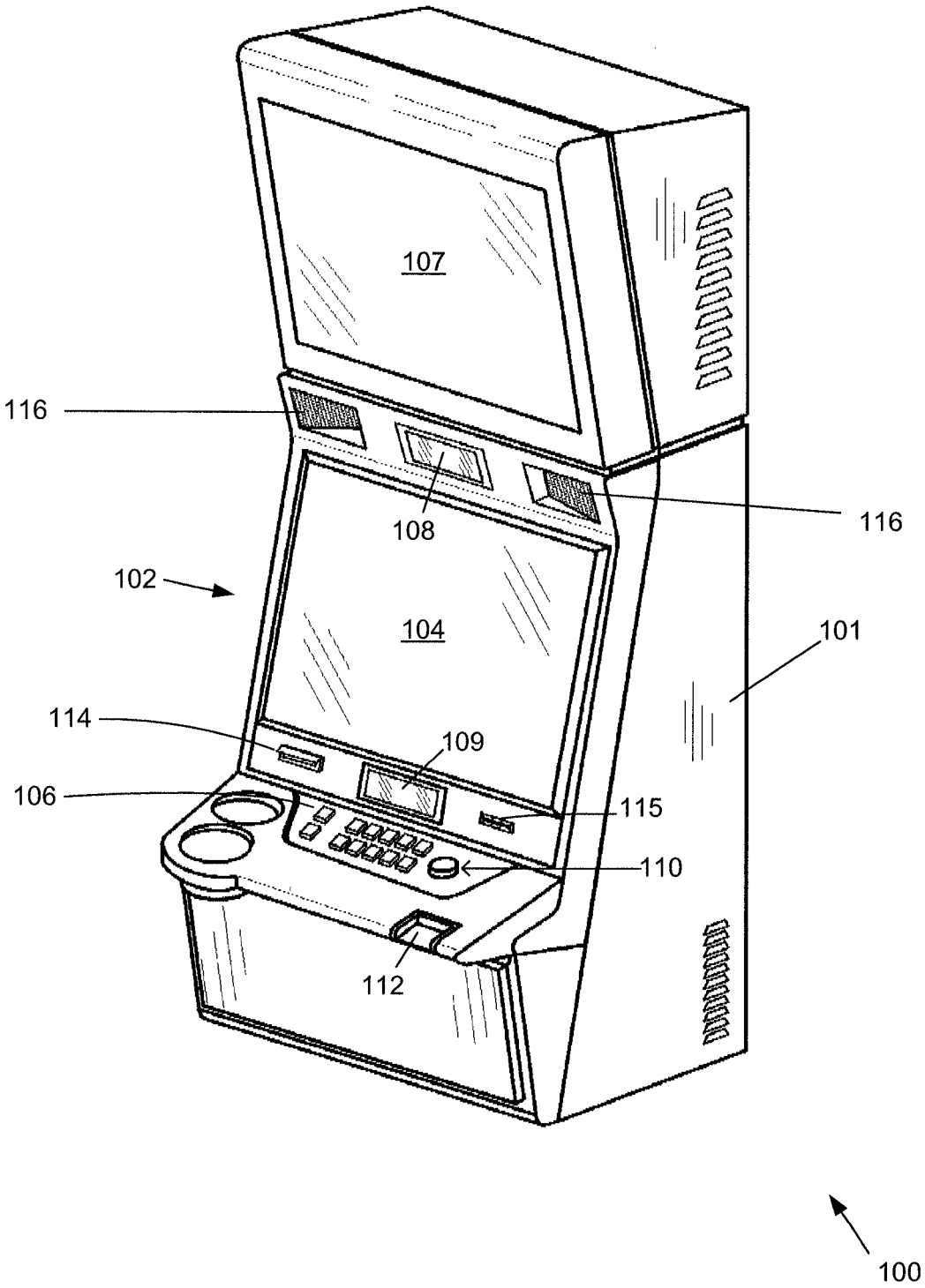
FIG. 1 is a view in front perspective of a gaming machine which may be used in a gaming system embodying the principles of the present invention.
Figure 2:
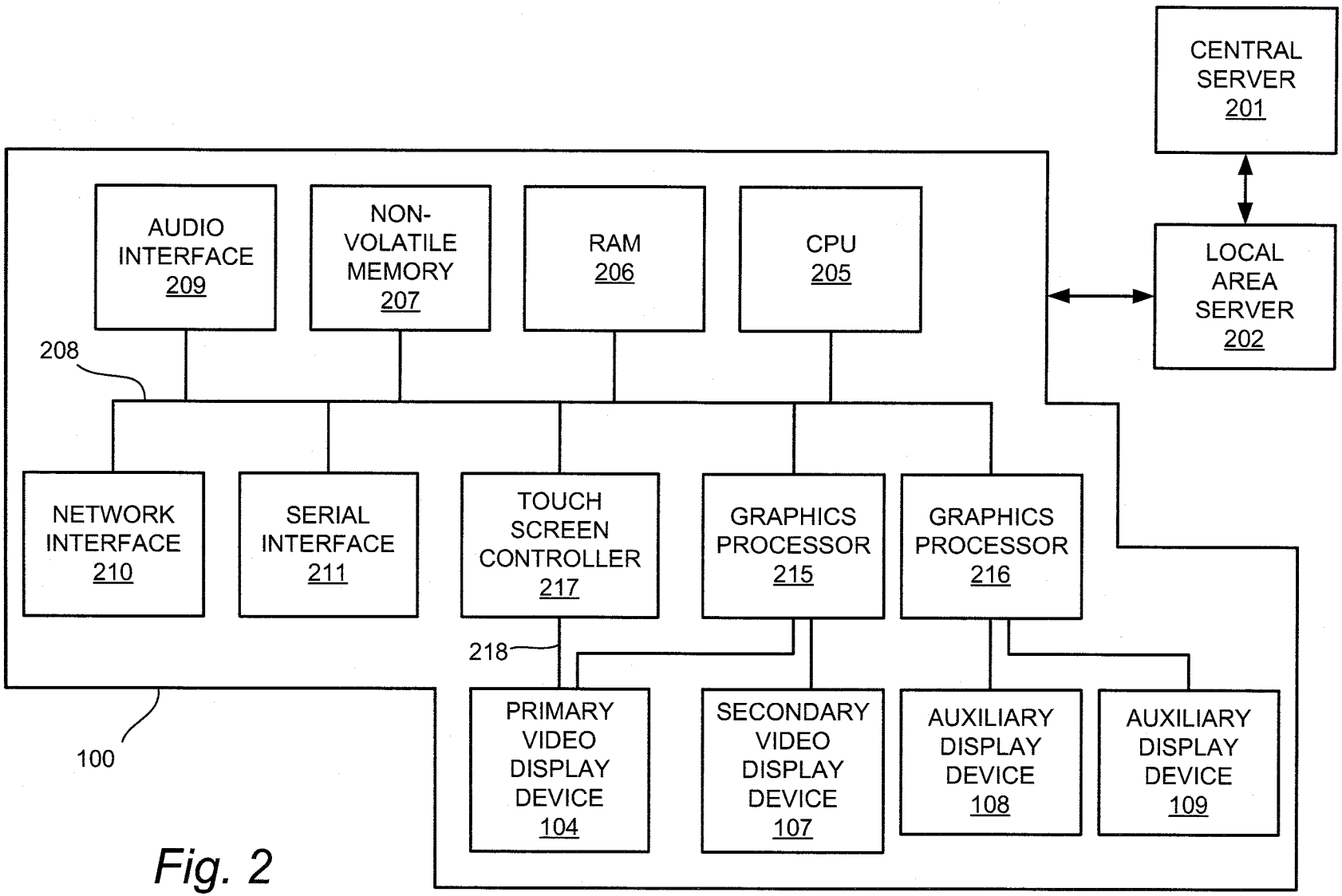
FIG. 2 is a diagrammatic representation showing various electronic components of the gaming machine shown in FIG. 1 and also showing external gaming system components that may be included with the gaming machine in a gaming system.

FIG. 1 shows a gaming machine 100 that may be used to implement a variable prize progression game according to the present invention. The block diagram of FIG. 2 shows further details of gaming machine 100 connected in a gaming system in which the present invention may be used to present gaming results to players.

Referring to FIG. 1, gaming machine 100 includes a cabinet 101 having a front side generally shown at reference numeral 102. A primary video display device 104 is mounted in a central portion of the front surface 102, with a ledge (button panel surface) 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future.

Gaming machine 100 illustrated in FIG. 1, also includes a number of mechanical control buttons 110 mounted on button panel surface 106. These control buttons 110 may allow a player to select a bet level, select pay lines, select a type of game or game feature, and actually start a play in a primary game. Other forms of gaming machines according to the invention may include switches, joysticks, or other mechanical input devices, and/or virtual buttons and other controls implemented on a suitable touch screen video display. For example, primary video display device 104 in gaming machine 100 provides a convenient display device for implementing touch screen controls.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 2 provides a block diagram showing various electronic components of gaming machine 100 together with gaming system components external to the gaming machine. In particular, FIG. 2 shows gaming machine 100 connected for communication with local area server 200 and central server 201. Local area server 200 and central server 201, or both servers, may cooperate to identify results that are provided to gaming machine 100 in response to a game play entered (initiated) at the gaming machine. That is, local area server 200 and/or central server 201, or more particularly, one or more processing devices associated with local area server 200 and/or central server 201 may serve as a result controller for identifying game results achieved for a particular play in a game. Even where gaming machine 100 implements a result controller to identify a result for a game play initiated at the gaming machine, local area server 200 and/or central server 201 may be used to provide player tracking and accounting services for gaming machine 100 and other gaming machines included in the gaming system. It should be understood, however, that some forms of gaming machines that implement variable prize progression games according to the present invention may be entirely stand-alone gaming machines that do not communicate with any other devices.

FIG. 2 shows that gaming machine 100 includes a central processing unit (CPU) 205 along with random access memory 206 and nonvolatile memory or storage device 207. All of these devices are connected on a system bus 208 with an audio interface device 209, a network interface 210, and a serial interface 211. A graphics processor 215 is also connected on bus 208 and is connected to drive the primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself comprises a thin film that is secured over the display surface of primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements are preferably mounted on a standard personal computer chassis and housed in a standard personal computer housing which is itself mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio interface 209, for example, may be connected to the system via a PCI or PCIe bus for example. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display devices included with the gaming machine 100. Also, a gaming machine implementing the present invention is not limited to any particular number of video display device or other types of display devices, provided some display arrangement is included for displaying the prize progression graphic, the player selectable objects, and the display modifications resulting from the selection of the various player selectable objects.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller and award controller for performing functions associated with a variable prize progression game according to the present invention. CPU 205 also executes software related to communications handled through network interface 210, and software related to various peripheral devices such as those connected to the system through audio interface 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for programs not in use or for other data generated or used in the course of gaming machine operation. Network interface 210 provides an interface to other components of a gaming system such as the servers 200 and 201 in the illustrated embodiment.

It should be noted that the invention is not limited to gaming machines employing the personal computer-type arrangement of processing devices and interfaces shown in example gaming machine 100. Other gaming machines through which a variable prize progression game is implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. It is possible to implement a variable prize progression game within the scope of the present invention using an electromechanical arrangement for displaying the prize progression graphic, the player selectable objects, and the display modifications resulting from the selection of the various player selectable objects. However, the most preferred forms of the invention utilize one or more video display devices for displaying the prize progression graphic, the player selectable objects, and the display modifications resulting from the selection of the various player selectable objects. For example, a gaming machine such as that shown in FIG. 1 may use primary video display device 104 to display a primary game and then transition to a display suitable for showing a variable prize progression game as a bonus game. The variable prize progression game would represent a "second screen bonus" in this scenario. As another example, a gaming machine suitable for providing a variable prize progression game may include a mechanical reel-type display rather than a video-type display device for displaying results in a primary game, and include a video display device for presenting the variable prize progression game as a bonus game. Thus, a gaming machine suitable for use in the present invention may have a structure similar to that shown for gaming machine 100 in FIG. 1, but with a mechanical reel-type display replacing the primary video display device 104, and with the video display device 107 being used for displaying the prize progression graphic, the selectable objects, and the modifications to the prize progression graphic resulting from the selection of the various selectable objects.

Figure 3:
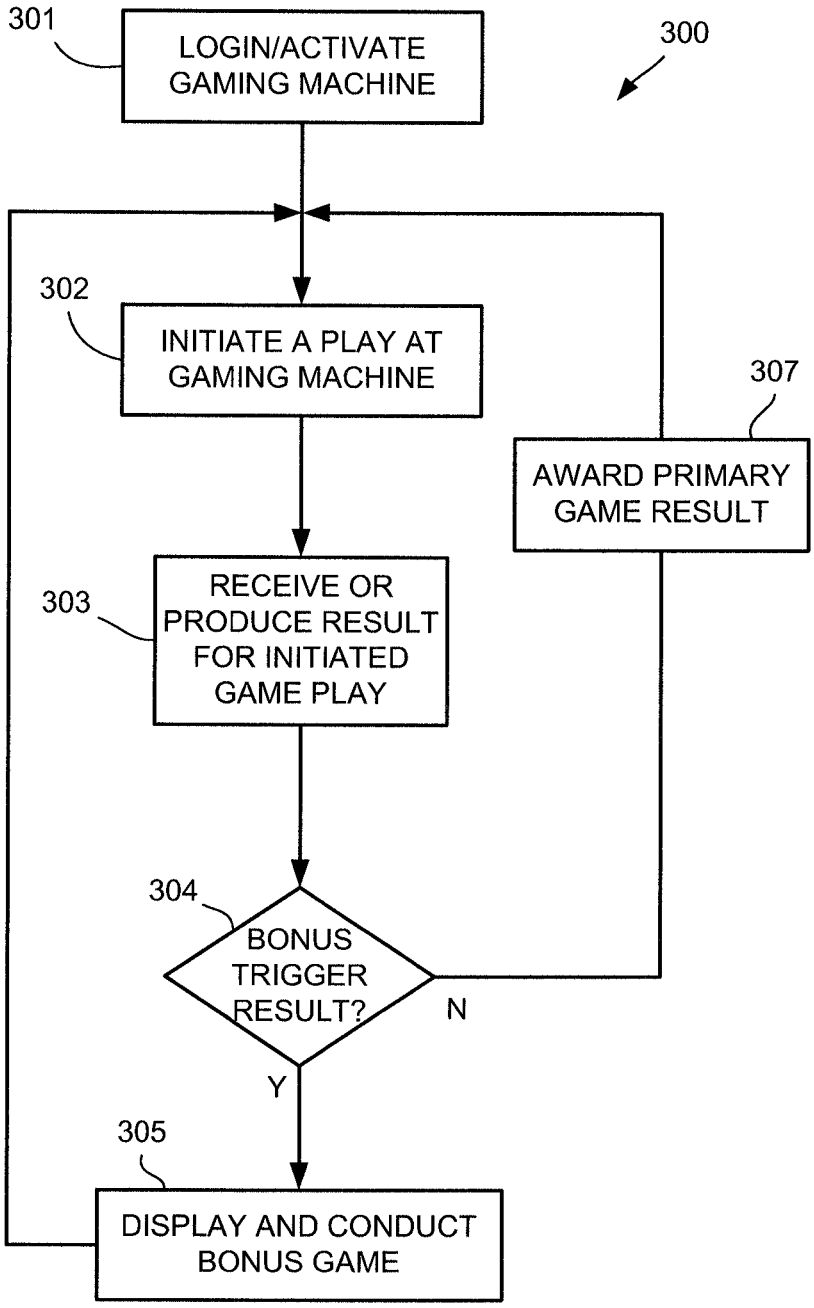
FIG. 3 is a flow chart showing the overall operation of a game that includes a variable prize progression component according to one embodiment of the invention.

FIG. 3 shows a process conducted at an individual gaming machine such as gaming machine 100 according to one form of the invention. In this form of the invention, the variable prize progression game is a bonus game that may become available in the course of play in a primary game at the gaming machine. This embodiment of the invention is not limited to any particular primary game. The primary game may be a reel-type game using either mechanical reels or video reels, a video poker or other playing card game, or any other game provided that the gaming machine includes a display device arrangement that facilitates displaying the various elements required of the variable prize progression game as will be described further below.

As shown in FIG. 3, once a player logs in or otherwise activates the gaming machine at process block 301, they may initiate a play in the primary game as indicated at process block 302. Initiating a play at a gaming machine typically requires one or more player inputs to start a game cycle in the particular game. A player may be required to select a bet level, select pay lines if the game is a multi-line reel-type game, and finally activate a play button or other play activating device. As indicated at process block 303, the game cycle includes either receiving a result for the game play from a result identifying device remote from the gaming machine or producing a result for the game play at the gaming machine itself. Whether produced locally at the gaming machine or produced at some remote device (such as one of the servers 201 and 202 shown in FIG. 2), the result may be produced by a result generating algorithm, by selecting a lottery record from a set of electronic lottery records, by electronically conducting a bingo game, or by any other suitable result generating device or arrangement of devices.

In this particular example, the nature of the primary game result is taken as a triggering event for triggering the variable prize progression game. If it is determined that the primary game result is a bonus triggering result as indicated by a positive outcome at decision block 304, the process proceeds to conduct the variable prize progression bonus game as indicated at process block 305. Upon completion of the bonus game, the process loops back to the point at which the player at the gaming machine may initiate another play in the primary game. If the result for the primary game is not a bonus triggering result as indicated by a negative outcome at decision block 304, the process proceeds to award the player any prize associated with the primary game result as indicated at process block 307, and then the process loops back to wait for the player to initiate another play in the primary game.

It should be noted that variable prize progression games according to the present invention need not be offered only as bonus games during the play of some primary game. In other forms of the invention the variable prize progression game may be a primary game offered at a particular gaming machine. Where a variable prize progression game represents a primary game, there may or may not be an associated bonus game.

In the example arrangement shown in FIG. 3 the bonus triggering result may or may not indicate a prize to be awarded for the variable prize progression bonus game to be conducted. In one implementation, a prize table for the primary game may incorporate bonus triggering results that include some total prize to be awarded in the bonus game. In this implementation the bonus game will be controlled so that it eventually displays to the player the prize indicated by the bonus triggering result. In other implementations the bonus triggering result built in to the prize distribution of the primary game may not include any fixed prize value and the play in the variable prize progression bonus game determines whether a prize will be awarded for participation in the bonus game and the amount of the prize. These alternatives will be discussed further below in connection with FIG. 4.

When a variable prize progression game is offered as a bonus game, the variable prize progression game may be triggered by something other than a result in a primary game. For example, a bonus game controller included in a gaming system (either at the gaming machine or at some remote device such as server 201 or 202 in FIG. 2) may determine when a variable prize progression bonus game is to be played through the gaming machine. The selection may be random, according to some schedule, or made in any other fashion. In the event the bonus triggering event is not a result in a primary game, the prize to be awarded for the given instance of the variable prize progression game may be predetermined or determined through the various player selections in the course of the variable prize progression game.

Figure 4:
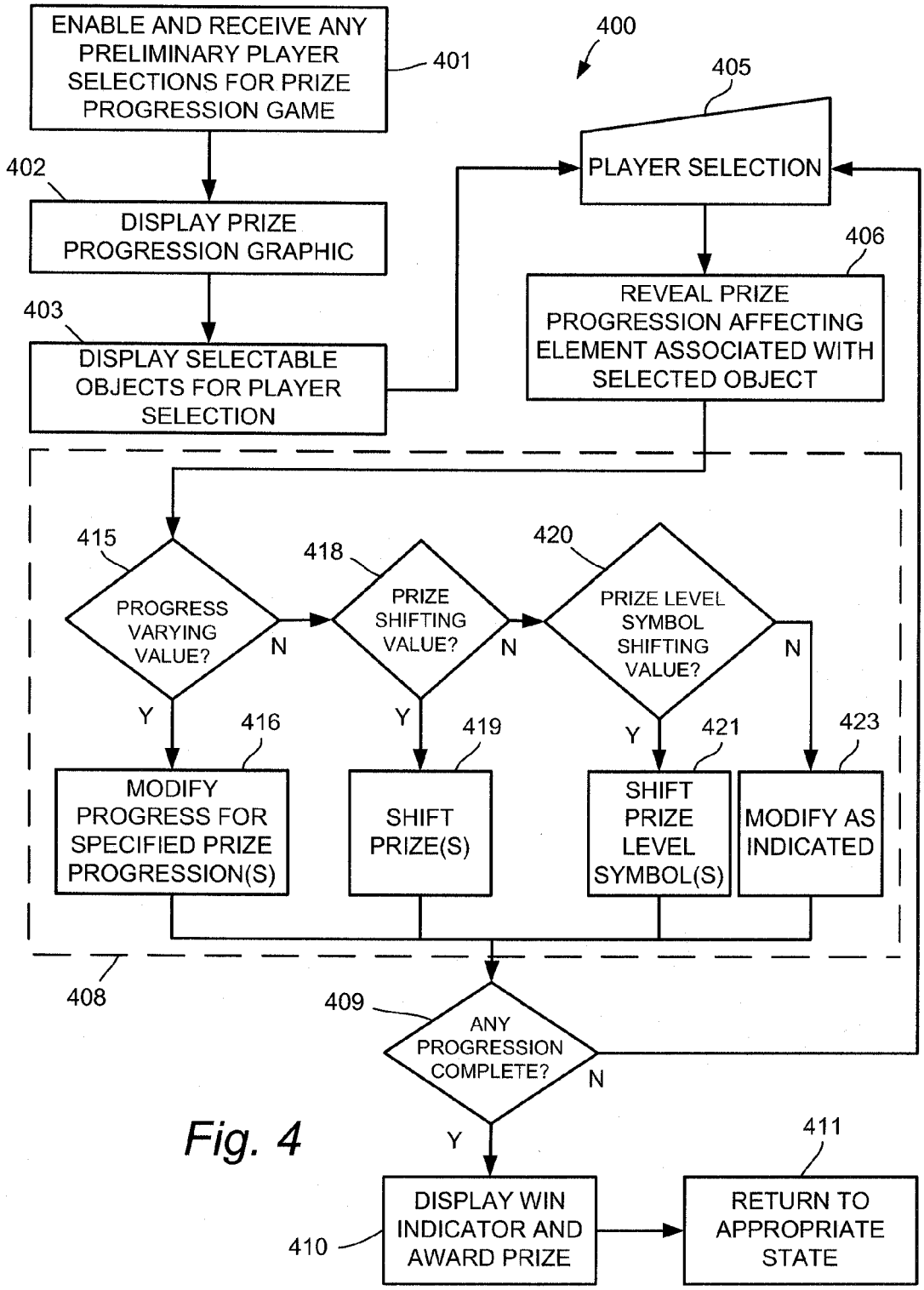
FIG. 4 is a flow chart showing the operation of a variable prize progression game according to one embodiment of the invention.

FIG. 4 shows a process 400 of conducting a variable prize progression game according to one preferred form of the invention. The process steps shown in FIG. 4 may represent the process of conducting a bonus game as indicated at process block 305 in FIG. 3. However, it will be appreciated that the same steps may be followed regardless of whether the particular variable prize progression game is offered as a bonus game or a primary game.

The process shown in FIG. 4 includes a preliminary step shown at process block 401. In particular, the illustrated process enables the gaming machine (such as a gaming machine 100 in FIGS. 1 and 2) to receive a preliminary player selection that may be used in the variable prize progression game. The example variable prize progression game described below with reference to the FIGS. 5 through 12 includes a preliminary player selection such as that indicated at process block 401. However, it should be appreciated that some forms of the present invention will not include or require any preliminary player selections but instead proceed directly to the variable prize progression game.

A variable prize progression game includes displaying the prize progression graphic as indicated at process block 402 and also displaying the selectable objects as indicated at process block 403. The player is then allowed or enabled to make a selection of one of the selectable objects as indicated at process block 405. Responsive to the player selection, the prize progression affecting element associated with the object selected by the player at block 405 is revealed as indicated at process block 406. After or in conjunction with revealing the prize progression affecting element, the process includes modifying the prize progression graphic in accordance with the revealed prize progression affecting element. The various steps that may be included in this modification are shown in dashed box 408 in FIG. 4. In addition to modifying the prize progression graphic, the process includes determining if any of the prize progressions are complete. If any of the prize progressions are complete as indicated by a positive outcome at decision box 409, the process proceeds to display an indication of the win, if any, associated with the completed prize progression, and award any associated prize as indicated at process block 410. The process then returns to the appropriate state as indicated at process block 411. This may include transitioning back to the primary game in an arrangement such as that shown in FIG. 3, or simply reinitiating the variable prize progression game in the event it is to be played again as a primary game. If there is no completed prize progression as indicated by negative outcome at decision block 409, the process loops back to enable or allow another player selection at process block 405.

The actions indicated at process blocks 401-406 in FIG. 4, together with the actions indicated within dashed box 408 are all preferably performed under the control of a presentation controller which may be implemented through CPU 205 shown in FIG. 2 or the alternatives described above. When the presentation controller is implemented as a general purpose data processor such as CPU 205, it executes prize progression program code to cause a gaming machine display arrangement to perform the display action shown at process block 410, and executes object display program code to cause the display arrangement to perform the action shown at process block 403. A general purpose data processor implemented presentation controller will also preferably execute selection program code to perform or direct the performance of the actions shown in process blocks 405 and 406 and in dashed box 408. The actions shown at blocks 409-411 in FIG. 4 are preferably performed under the control of an award controller which also may be implemented through CPU 205 in FIG. 2. A general purpose processor implemented award controller will preferably perform award program code to perform or direct the performance of the actions shown at process blocks 409 and 410 in FIG. 4, and perhaps the action shown at process block 411.

In the example process shown in FIG. 4, it is assumed that the selectable objects may reveal a progress varying value, a prize shifting value, or a prize level symbol shifting value. There may be other types of values or symbols revealed in connection with a selectable object that has been selected by a player. If the revealed prize progression affecting element is a progress varying value as indicated by a positive outcome at decision box 415, the process proceeds to modify the progress for the specified prize progression(s) as indicated at process block 416. If the revealed a prize progression affecting element comprises a prize shifting value as indicated by a positive outcome at decision box 418, the process proceeds to shift one or more prizes as indicated by the prize shifting value. This prize shifting is shown at process block 419 in FIG. 4. If the revealed prize progression affecting element is a prize level symbol shifting element as indicated by a positive outcome at process block 420, the process includes shifting the prize level symbol or multiple symbols as indicated by the revealed value. This prize level symbol shifting is indicated at process block 421 and FIG. 4. If any other type of prize progression affecting element is revealed, the process modifies the prize progression graphic in accordance with that element as shown at process block 423.

The player selection indicated at process block 405 may be entered by the player in any suitable manner according to the present invention. One convenient embodiment of the invention displays the various selectable objects as buttons/icons on a touchscreen device so that a selection may be made simply by touching the desired selectable object. That is, the selectable objects are all displayed concurrently and the player is allowed to make some input to select a particular one of the concurrently displayed selectable objects. Other forms of the invention may use mechanical buttons to allow the player to make their selection or may use a suitable pointing device (cursor control) to enable a player to point to and select one of the displayed selectable objects. It is also possible within the scope of the invention that the selection of a selectable object may be indirect. That is, a game within the scope of the invention may be configured so that a player simply presses a selection button to request a selection from a number of displayed selectable objects and a selection is made for the player, either randomly or in some other fashion. In this case the prize progression affecting element associated with each selectable object need not be concealed at the time the player requests a selection. The invention encompasses both direct player selections and indirect player selections and combinations of the two. It is also possible that player selections may be made from an apparently sequentially arranged set of selectable objects. For example, the selectable objects may be displayed as a deck of face down cards and the player's selection will be a selection from the top of that deck. In this deck of cards embodiment, the selectable objects are not displayed concurrently. That is, the top face down card is displayed to the player while the remaining face down cards are covered by the top card and thus not concurrently visible with the top card.

It will be appreciated that the description used in this disclosure that the selectable objects each "conceal" a respective prize progression affecting element is a reference to a graphic artifice and not necessarily a physical concealment. That is, where the selectable objects are displayed through a video display device such as device 104 and/or 107 shown in FIGS. 1 and 2, the objects shown on the video display device do not in fact actually conceal any associated prize progression affecting element. Rather, the prize progression affecting element associated with a respective selectable object is simply not displayed or not displayed as associated with the particular selectable object. The term "conceal" is used herein simply to indicate that a prize progression affecting element that is ultimately associated with a respective selectable object is not shown as being associated with that selectable object prior to the selection, and only revealed in response to the player's selection of the respective selectable object.

The present invention does not require a specific association between each selectable object and a given prize progression affecting element. That is, it is not necessary that each selectable object remains throughout the game associated with a particular prize progression affecting element. Rather, a prize progression affecting element may be associated with the selectable objects as necessary to achieve some overall result for the variable prize progression game. That is, as player selections are made in a given instance of a variable prize progression game according to the invention, prize progression affecting elements may be revealed as necessary to ultimately show a previously determined result for the instance of the game. In these forms of the invention, the player's selection does not affect the outcome of the variable prize progression game. For example, where the variable prize progression game comprises a bonus game that may be entered in the course of play in some primary game, as discussed above with reference to FIG. 3, the result obtained in the primary game may dictate a result for the variable prize progression game. One way to ensure that the variable prize progression game ultimately shows the result dictated by the primary game is to associate prize progression affecting elements with the various selections made by or for the player so as to ensure the prize indicated for the variable prize progression game matches the prize corresponding to the dictated result.

In forms of the invention in which a prize is dictated for an instance of the variable prize progression game event before the player selections begin, a presentation controller associated with the gaming machine or a remote data processor may have access to a number of stored scripts listing a number of actions to be conducted in a variable prize progression game. The actions each correspond to a particular prize progression affecting element and will result in a particular prize being shown at the completion of the script. A number of different scripts may be stored for each potential result in the variable prize progression game. In this implementation of the invention, the presentation controller may randomly select a script for a given prize dictated for a variable prize progression game. This selection is from the number of scripts available for the given result. Data files for the scripts may be stored in suitable memory at the gaming machine itself or may be communicated to the gaming machine from a suitable external device such as one of the servers 201 and 202 shown in FIG. 2. As yet another alternative, a script may be produced on the fly for a given result. In any case, such a script forces at least some of the player's selections of a selectable object so that the player's selections do not in fact determine the prize progression affecting element that is revealed by virtue of the selections.

However, some forms of the invention may in fact maintain an association between the various selectable objects and particular prize progression affecting elements. In this case, the player's selection actually affects the nature of the prize progression affecting element that is revealed and ultimately may affect the prize that is awarded for participation in the variable prize progression game. In these implementations of the invention, the gaming machine or some remote processing device in the gaming system may store a data structure that relates each selectable object to a respective prize progression affecting element or perhaps multiple alternative prize progression affecting elements. This data structure may be accessed upon each player selection of a selectable object to retrieve a particular prize progression affecting element associated with a given selectable object that has been selected, and the prize progression graphic may be modified according to that retrieved prize progression affecting element. In the case where a selectable object is related in a data structure to multiple alternative prize progression affecting elements, the processing device may be controlled to randomly select one of the alternative elements to be revealed in response to the player's selection.

The process illustrated for purposes of example in FIG. 4 shows the various types of prize progression affecting elements as being exclusive for a given player selection. However, alternative forms of the invention may no maintain this exclusivity. That is, a give prize progression affecting element may both vary the progress of one or more of the prize progressions and have some other affect such as shift a prize value, for example.

Figure 5:
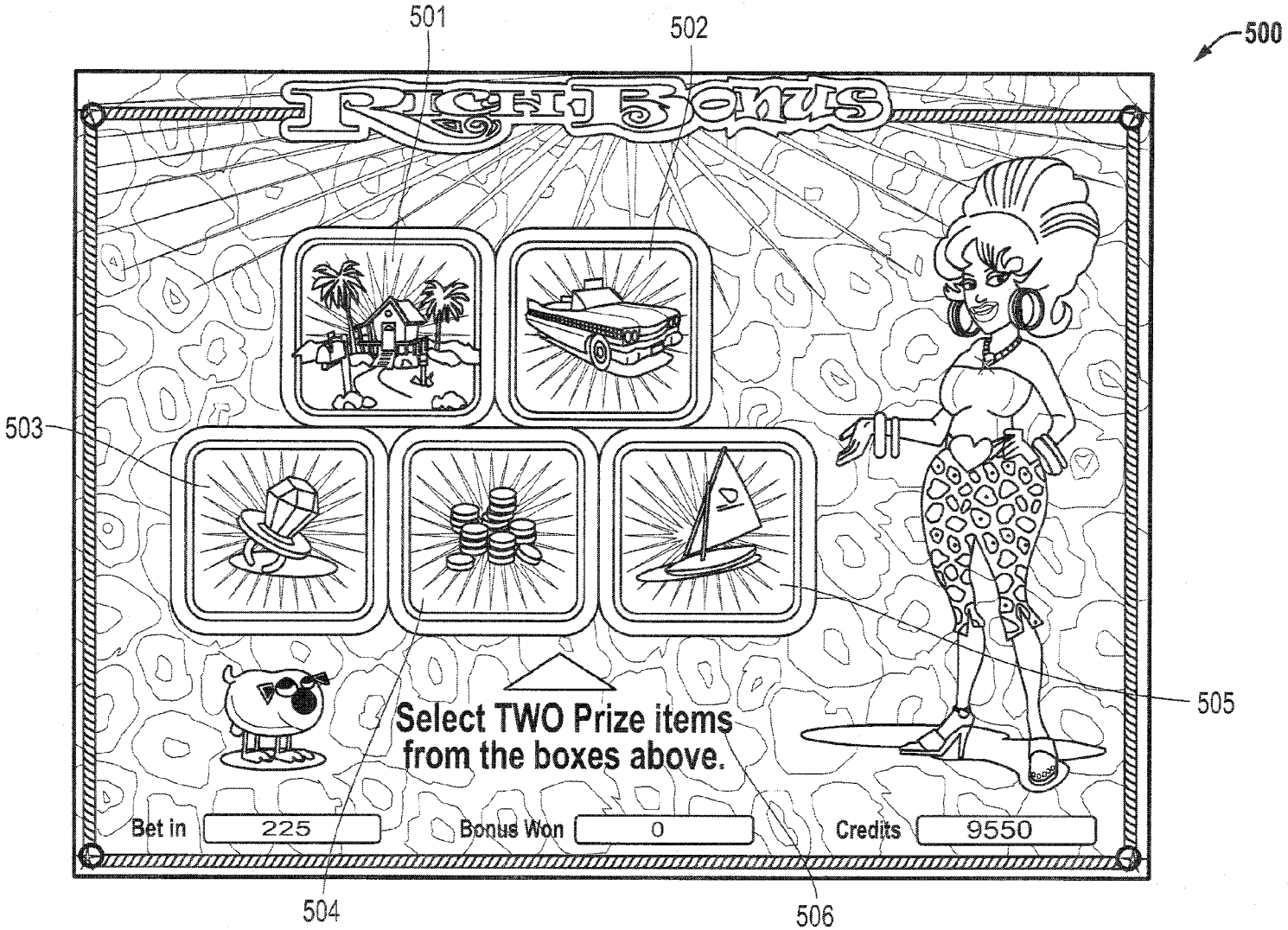
FIG. 5 is a representation of a graphic display used to facilitate player selection of a prize level symbol according to one form of the present invention.

FIG. 5 is a graphic representation showing a preliminary selection graphic 500 that may be displayed before a prize progression graphic in some implementations of variable prize progression games according to the invention. This preliminary selection graphic 500 is associated with the preliminary player selection step shown at process block 401 in FIG. 4, and may be displayed on a suitable video display device such as video display device 104 or 107 shown in FIGS. 1 and 2. The illustrated example preliminary selection graphic 500 shows five different prize level symbols 501, 502, 503, 504, and 505. Each of these prize level symbols represents a type of object or collection of objects and conveys an indication of value. For example, prize level symbol 502 includes a representation of a taxi which represents a relatively low value level. In this example, each of the prize level symbols 501 through 505 comprises a touch screen icon which the player may select by simply touching the display screen in the area of the respective icon. As indicated by the instruction legend 506 in this example preliminary selection graphic 500, the player may select two of the prize level symbols in this particular implementation.

Figure 6:
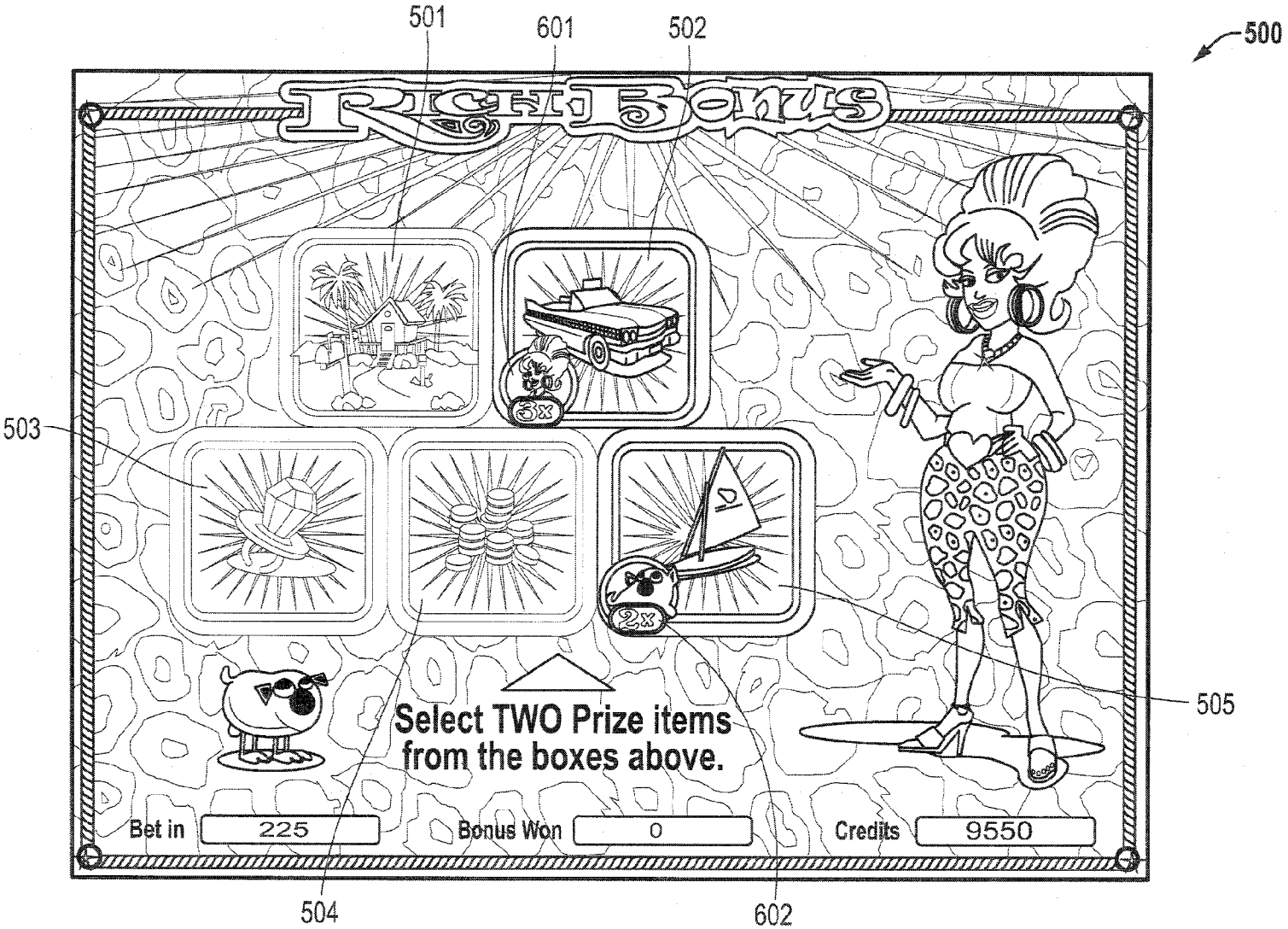
FIG. 6 is a representation of the graphic display shown in FIG. 5 as modified in response to a player selection of two prize level symbols.

FIG. 6 shows the preliminary selection graphic 500 after it has been modified in response to the player's selection of two of the prize level symbols. In particular, the modified graphic 500 shown in FIG. 6 indicates that prize level symbols 502 and 505 have been selected. Prize level symbol 502 was selected first and (in accordance with game rules for this particular implementation) has been modified with a multiplier symbol 601 shown in the lower left corner of prize level symbol 502 in this example. Prize level symbol 505 represents the player's second selection and (again, according to the particular implementation rules) has been modified to show a multiplier symbol 602 comprising a lower multiplier value than the multiplier value associated with multiplier symbol 601. The effect of the preliminary selection facilitated through preliminary selection graphic 500 will be described further below in connection with a particular variable prize progression game embodying one form of the present invention.

Figure 7:
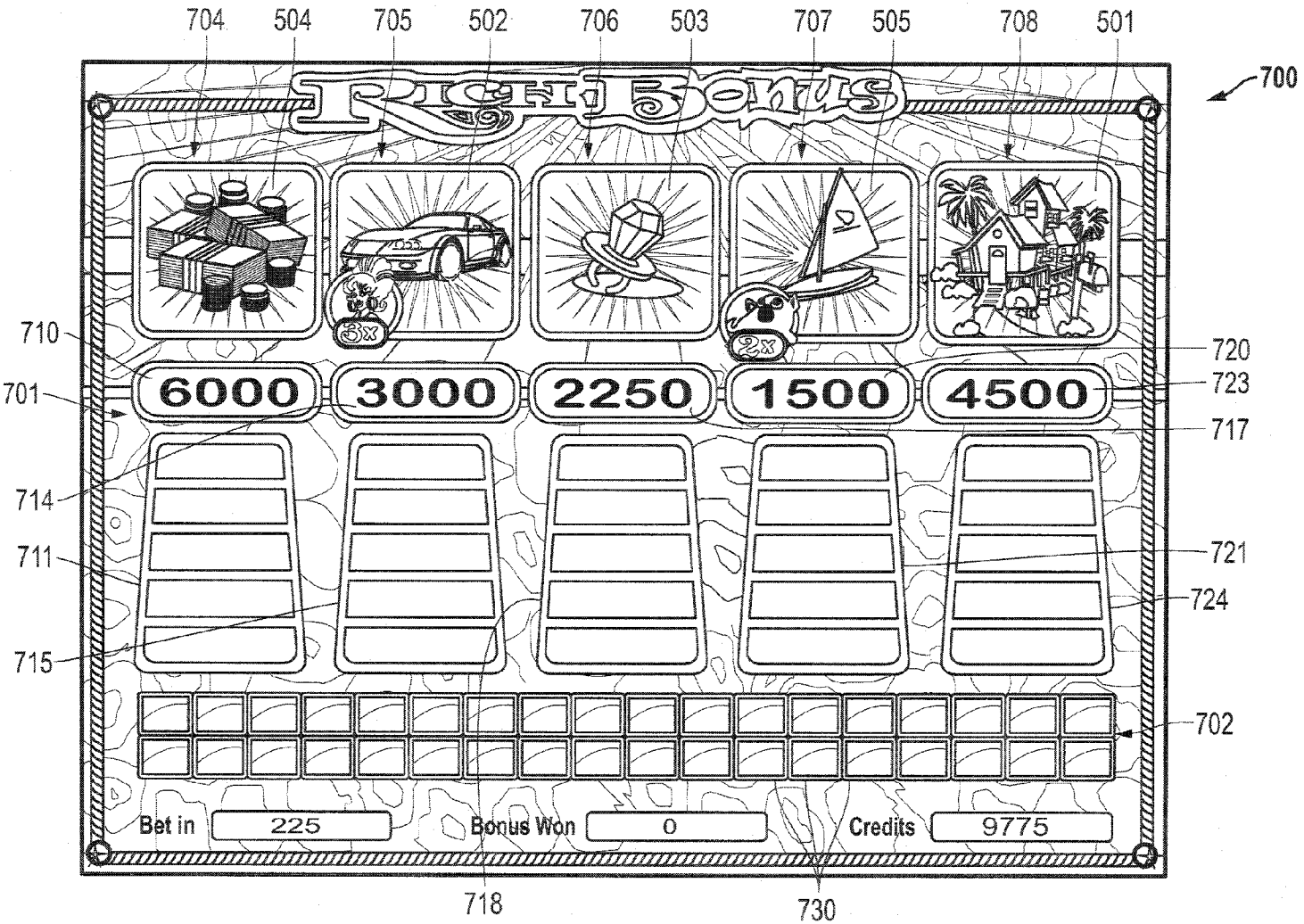
FIG. 7 is a representation of a graphic display showing an initial state of a prize progression graphic and selectable objects according to one embodiment of the invention.

FIG. 7 shows a graphic representation 700 that may be displayed on a suitable video display device to display a prize progression graphic shown generally at 701 and a number of selectable objects shown generally at 702. The prize progression graphic 701 and group of selectable objects 702 are displayed in accordance with the process steps shown at 402 and 403 in FIG. 4. This particular example graphic representation is preferably produced on a suitable display device such as a video display device 104 or video display device 107 associated with gaming machine 100 shown in FIGS. 1 and 2. Prize progression graphic 701 includes five different prize progressions shown generally at 704, 705, 706, 707, and 708. Each of these prize progressions may be uniquely associated with a particular color which distinguishes it from the other prize progressions. For example, a segment in each progression segment set may be displayed with a given color unique with respect to the other progression segments. Although different colors provide a convenient way to distinguish the different prize progressions, any suitable arrangement may be used to distinguish prize progressions used within the scope of the present invention. Each prize progression 704-708 includes a respective set of progression segments, a respective prize, and a respective one of the prize level symbols from graphic representation 500 shown in FIGS. 5 and 6. In particular, prize progression 704 includes prize level symbol 504, prize 710, and progression segment set 711, whereas prize progression 705 includes prize level symbol 502, prize 714, and progression segment set 715. Prize progression 706 includes prize level symbol 503, prize 717, and progression segment set 718. Prize progression 707 includes prize level symbol 505, prize 720, and progression segment set 721, whereas prize progression 708 includes prize level symbol 501, prize 723, and progression segment set 724.

It will be noted by comparing graphic representation 500 in FIG. 5 and graphic representation 700 in FIG. 7 that some of the prize level symbols 501-505 have been modified from their respective appearance shown in FIG. 5. Specifically, in this implementation of the invention, the respective prize level symbol is modified to indicate a value that coincides with the relative value of the prize for the particular prize progression with which the prize level symbol is included. For example prize level symbol 504 in FIG. 7, which comprises a representation of currency, shows relatively more currency than indicated in graphic representation 500 of FIG. 5 because the symbol is now associated with prize progression 704 which includes a relatively high 6000 unit prize, prize 710. Similarly prize level symbol 502 in FIG. 7 has been modified from its relatively low value form shown in FIG. 5 to show a relatively more valuable automobile considering that the prize level symbol is included in prize progression 705, and therefore associated with a medium level, 3000 unit prize, prize 714. In this particular implementation, a prize level symbol that is included in a prize progression associated with a relatively low value prize retains the low value appearance shown in FIG. 5. For example, prize level symbol 505 remains a symbol of a relatively low value sailboat in FIG. 7 since it is included in prize progression 707 which is associated with prize 720, a relatively low value, 1500 unit prize.

The set of selectable objects 702 shown in FIG. 7 comprises in this example thirty-six different tiles 730. Each of these tiles 730 preferably comprises a touch screen icon that may be selected simply by touching the screen area showing the respective tile. In some forms of the invention that are not implemented through a touchscreen video display device, a pointer (cursor) may be controlled through a suitable player input arrangement associated with the gaming machine (such as certain of the buttons 110 of gaming machine 100 shown in FIG. 1) to select the various tiles 730 as desired during the course of play. The present invention encompasses any suitable arrangement for enabling a player to select selectable objects such as tiles 730. The invention also encompasses any suitable number of selectable objects such as tiles 730.

It will be noted that the various associations between prizes, prize progressions, and prize level symbols in the prize progression graphic 701 shown in FIG. 7 may be made randomly or in any suitable manner within the scope of the present invention. For example, the respective prize included in (assigned to) a respective prize progression may be assigned randomly and in no relative order between the various prize progressions, and the various prize level symbols 501-505 may be selected so as to be consistent with the respective prize for that prize progression. Alternatively, the various prizes available in a given instance of a variable prize progression game according to the present invention, and the various prize level symbols, may be assigned to, the various prize progressions in some relative order. The invention encompasses any suitable arrangement for assigning prizes to the various prize progressions 704-708 and for assigning the consistent prize level symbols 501-505 to the prize progressions. The invention also encompasses any arrangement for selecting the prizes to be used in a given variable prize progression game. Of course, in the scripted version of the variable prize progression game, one of the prizes available in the graphic would need to correspond to the prize to be awarded for the given instance of the variable prize progression game either directly or after application of an available multiplier.

Figure 8:
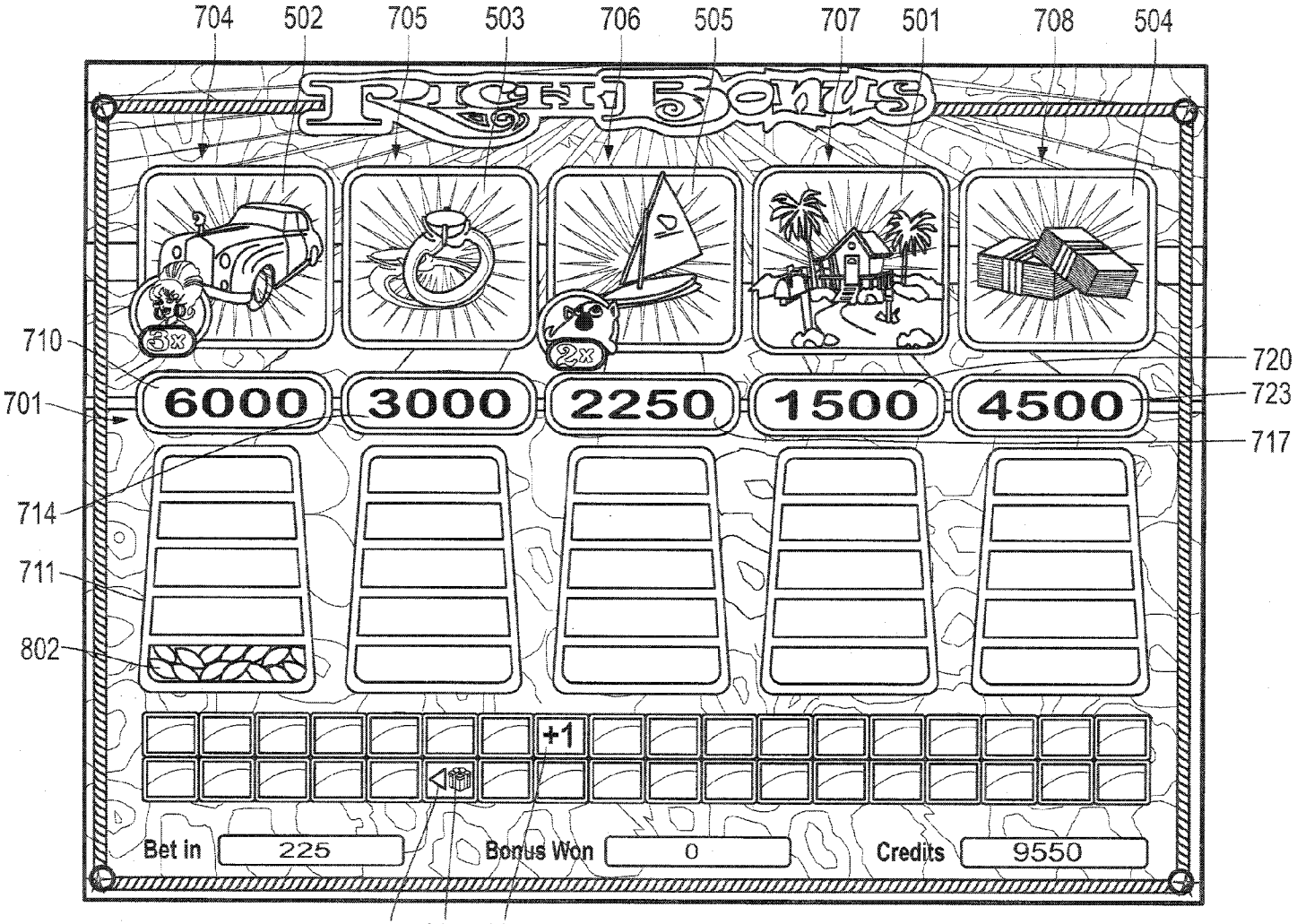
FIG. 8 is a representation of the graphic display shown in FIG. 7 as modified in response to two different object selections.

FIG. 8 shows prize progression graphic 701 and the set of selectable objects 702 after they have both been modified by two player selections of selectable objects (tiles 730) according to the invention. In particular, FIG. 8 shows prize progression graphic 701 after a variable prize progression game has proceeded two cycles through the player selection step 405, progression affecting element reveal step 406, and prize progression graphic modification step 408 in FIG. 4. For purposes of this discussion, it will be assumed that object 801 represents the first of the two player selections. Selected object 801 is illustrated as having revealed a progress varying value "+1" for a particular one of the prize progressions, in this case prize progression 704. A color associated with selected object 801 preferably corresponds to the unique color associated with prize progression 704 to indicate that the particular progress varying value associated with object 801 is to modify that particular prize progression. In response to revealing the progress varying value "+1" of object 801, prize progression graphic 701 is modified by marking one of the segments 802 in progression segment set 711 for prize progression 704. This modification corresponds to the step taken at process block 416 in FIG. 4, and represents a partial completion of the prize progression segment set. That is, a first segment 802 is completed by virtue of the displayed progress varying value "+1" revealed at selected object 801.

The second selected object 804 shown in FIG. 8 revealed a prize level symbol shifting value represented by an arrow indicating a shift in direction and an icon representing a prize object, in this case, a gift-wrapped box 805. In response to the prize level symbol shifting value revealed by virtue of the selection of object 804, prize progression graphic 701 shown in FIG. 8 has been modified to shift the prize level symbols one place to the left in the orientation of the figure consistent with the left pointing arrow associated with icon 805. Thus, prize level symbol 502 is now associated with prize progression 704 whereas prize level symbol 503 is associated with prize progression 705, prize level symbol 505 is associated with prize progression 706, prize level symbol 501 is associated with prize progression 707, and prize level symbol 504 has shifted to be associated with prize progression 708. It will be noted by comparing FIGS. 7 and 8 that the relative value indicated by the respective prize level symbol 501-505 has been modified in accordance with the prize value with which the symbol is now associated. For example, having been shifted over to be associated with a relatively high 6000 unit prize, prize 710, prize level symbol 502 is now shown as a luxury automobile. Prize level symbol 503 has also been modified to show a relatively more valuable object now that it is associated with a relatively higher 3000 unit prize, prize 714. It should also be noted that prize level symbol 501 has been modified from its state shown in FIG. 7 to indicate a lower value since it is now associated in FIG. 8 with prize progression 707 and its relatively low, 1500 credit prize, prize 720. Some forms of the invention may include three different states of each prize level symbol, each state corresponding to a different range of prize values comprising high-value prizes, mid-value prizes, and low-value prizes. Finally it will be noted that the prize level symbols selected by the player in the preliminary selection indicated in FIG. 6 apply their respective multiplier to a different prize progression in FIG. 8 as compared to the state of the prize progression graphic 701 in FIG. 7. In one preferred form of the invention utilizing prize level symbols, the only effect of a prize level symbol on the outcome of the variable prize progression game is to apply any associated multiplier or other prize enhancer to enhance a prize associated with a given prize progression which is ultimately awarded to the player.

Figure 9:
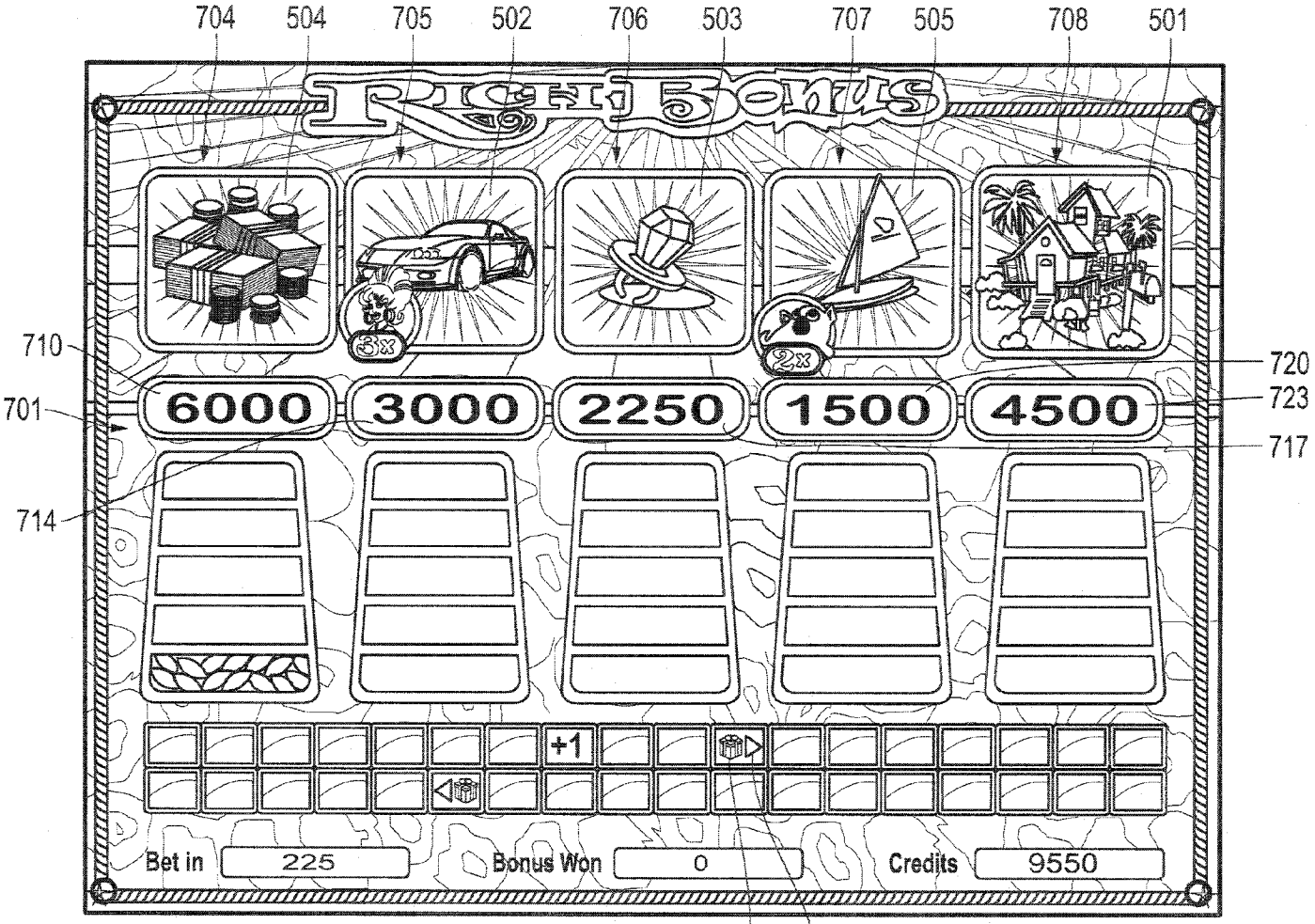
FIG. 9 is a representation of the graphic display shown in FIG. 8 as modified in response to another object selection and corresponding modification to the prize progression graphic.

FIG. 9 shows the state of prize progression graphic 701 after an additional selectable object has been selected, the prize progression affecting element has been revealed, and the prize progression graphic has been modified according to the cycle of steps shown at 405, 406, and 408 in FIG. 4. In this example, the player has selected object 901 to reveal another prize level symbol shifting value indicated by gift-wrapped box icon 902 and a shift direction indicator. Thus as compared to the state of prize progression graphic 701 and FIG. 8, prize progression graphic 701 in FIG. 9 shows the various prize level symbols 501-505 shifted back to the right in accordance with the right shift arrow included with the prize level symbol shifting value associated with selected object 901. Note that the value indicated by each prize level symbol has been modified in accordance with the prize associated with the prize progression to which the respective prize level symbol has been moved.

Figure 10:
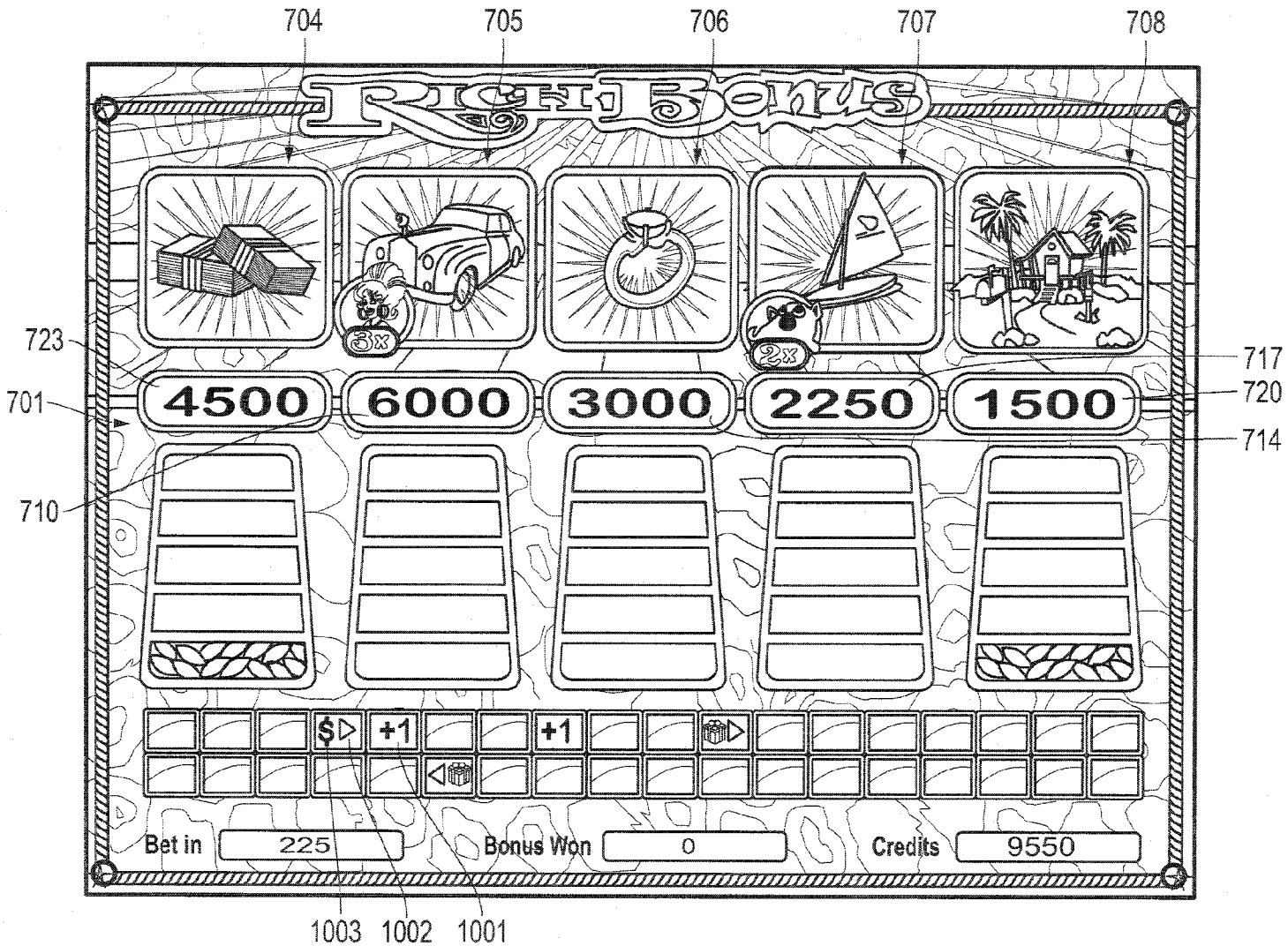
FIG. 10 is a representation of the graphic display shown in FIG. 9 as modified in response to two additional object selections.

FIG. 10 shows the state of prize progression graphic 701 after two additional selectable objects have been selected by the player, namely, selected object 1001 and selected object 1002. Selected object 1001 has revealed a progress affecting element comprising a progress varying value "+1" for a specific one of the prize progressions, in this case prize progression 708. Again the preferred association between the particular progress varying value and prize progression is made in this example by any unique color associated with the revealed prize progression affecting element and corresponding unique color associated with the affected prize progression. That is, the color associated with the progression affecting element revealed through selected object 1001 corresponds to a color associated with prize progression 708, and thus the progress varying value "+1" associated with selected object 1001 is applied to prize progression 708. As mentioned above, any arrangement may be used to associate particular progression affecting elements to particular prize progressions, and the invention is not limited to associations by color.

Selected object 1002 revealed a prize progression affecting element comprising a prize shifting value. This prize shifting value is indicated by the dollar sign 1003 and the direction indicating arrow, in this case comprising a right pointing arrow to indicate a right prize shift. This right prize shift has caused the prizes associated with each prize progression to shift one position to the right in prize progression graphic 701 shown in FIG. 10 as compared to the prize progression graphic 701 shown in FIG. 9. For example, prize 710, which had been included in prize progression 704 as shown in FIGS.

7-9 is shown in FIG. 10 as being associated with prize progression 705. This shifting of prizes during the course of the prize progression game generates a great deal of excitement as players make their selections of selectable objects and make progress toward the various prizes. In the course of the game, the player knows that a given selectable object may reveal a prize shift to shift a high-value prize to a more advantageous position for the player. For example, the relatively high-value 6000 unit prize, prize 710, has been advantageously moved in FIG. 10 to prize progression 705 to which the 3× multiplier would apply if the player is able to complete that prize progression. Of course the player also knows that on any selection of a selectable object in the game, a particular prize may be shifted to a relatively less advantageous position for the player, such as, for example, from a nearly completed progression segment set to a relatively incomplete progression segment set.

Figure 11:
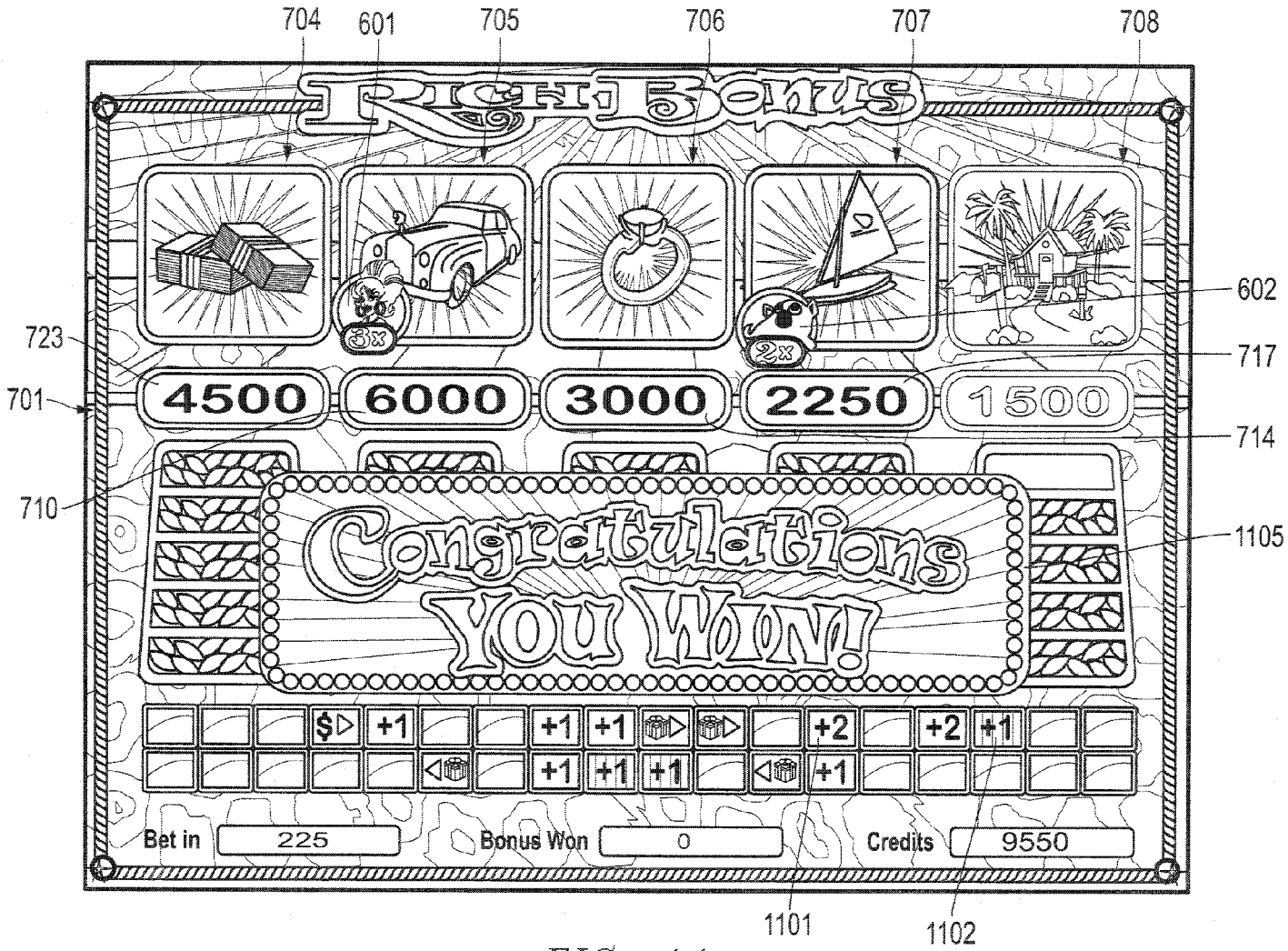
FIG. 11 is a representation of the graphic display shown in FIG. 10 as modified in response to a number of other object selections to complete a prize progression, and showing a completion indicator.
Figure 12:
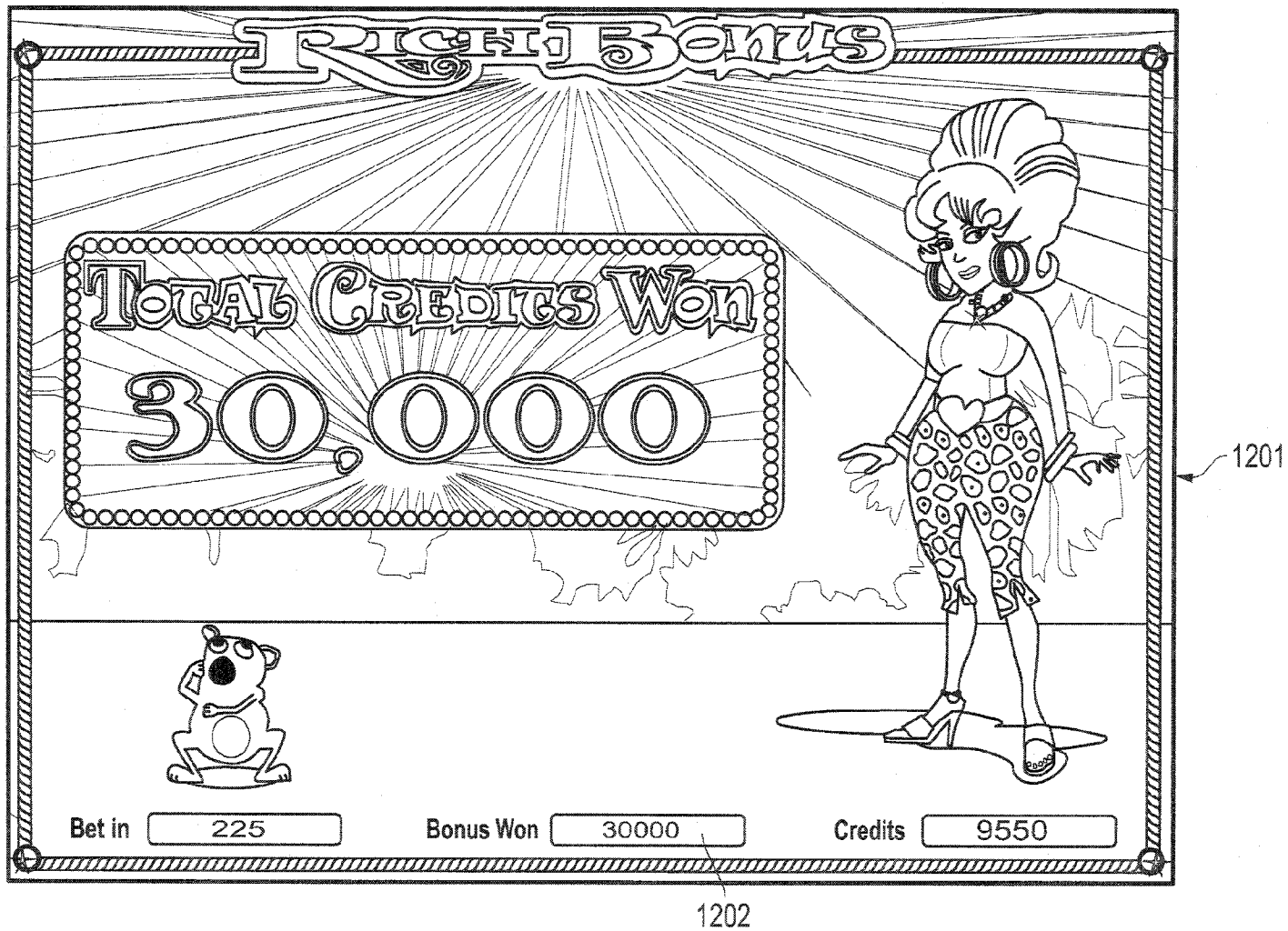
FIG. 12 is a representation of a graphic display that may be used to display a player award resulting from the player's participation in the variable prize progression game which is completed as shown in FIG. 11.

FIG. 11 shows a state of prize progression graphic 701 after a number of additional player selections of selectable objects. For example, selectable object 1101 has revealed a prize progression affecting element comprising a progress varying value of "+2" for completing two segments in a particular one of the prize progressions. Selected object 1102 shows an example of a prize progression affecting element comprising a progress varying value "+1" that applies to all of the prize progressions as indicated by multiple colors included with the revealed prize progression affecting element. The invention is not limited to any particular values for progress varying values, prize shifting values, or prize level symbol shifting values. Prize shifting values and prize level symbol shifting values may shift one or more places in either direction within the scope of the present invention. Furthermore, the progress varying values need not be positive values but could comprise a negative value in some cases. Progress varying values may also be variable. For example, a given progress varying value may indicate that one or more prize progressions are to be completed regardless of the number of segments left to traverse in the respective prize progressions.

It is assumed for the purposes of FIG. 11 that the last player selection revealed a progression affecting element that completed one or more of the progression segments. In this particular example, prize progressions 704, 705, 706, and 707 have all been completed on the last player selection and revealed prize progression affecting element. According to the rules of the game in this example implementation, the completion of each progression segment set entitles the player to the prize included for that completed progression, as multiplied by any multiplier associated with the prize level symbol for the given prize progression. Prize progression graphic 701 shown in FIG. 11 is also modified with a win indicating element 1105 to indicate to the player that the particular variable prize progression game is completed and that the player is entitled to a prize for their participation in the game. In this example, the player is entitled to prize 717 multiplied by multiplier value 602, prize 714, prize 710 multiplied by multiplier value 601, and prize 723, which add up to a total prize of 30,000 units (credits in this case) as indicated by the conclusion graphic for the game shown in FIG. 12. In this particular example, the 30,000 credit win is displayed in the bonus won window 1202 in FIG. 12.

The example displays shown in FIGS. 5-12 are shown only as convenient examples for describing the principles of the invention. Many variations on these basic examples may be employed within the scope of the present invention. In particular, the invention is not limited to any particular arrangement or style of graphics within the prize progression graphic or in the selectable objects, or the number of multiple prize progressions included in the prize progression graphic. It should also be noted that a mechanical or electromechanical display device may be used to display the prize progression graphic and the selectable objects. The present invention encompasses video-generated prize progression graphics and selectable objects and electro-mechanical displays for the prize progression graphics and selectable objects. Furthermore, numerous other types of progression affecting elements may be used within the scope of the invention to vary the progress for a given prize progression and to vary the prizes for the different prize progressions.

As used herein, the terms "comprising," "including," "carrying," "having," "containing," "involving," and the like are to be understood to be open-ended, that is, to mean including but not limited to. Any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention. For example, although the forms of the invention described above show only a single prize included in each of the different prize progressions, the invention encompasses any number of prizes, any of which may shift individually in response to a respective prize shifting value, or shift with one or more other prizes in response to other prize shifting values. Also, although the variable prize progression games are described above in the context of arrangements in which the player makes selections until one of the prize progressions is complete, other forms of the invention may give the player some number of selections and the game may be considered complete once the player makes their final selection, whether or not any of the prize progressions has been completed.

The invention claimed is:

1. A method of displaying a gaming result, the method including:

(a) displaying a prize progression graphic on a display device of a gaming machine for a player, the prize progression graphic being displayed under the control of at least one processor associated with the gaming machine and including a number of prize progressions with each respective prize progression including a respective prize and a respective set of progression segments;

(b) displaying a number of objects on the display device or an additional display device of the gaming machine, each object corresponding to a respective prize progression affecting element;

(c) in response to a selection of a respective object corresponding to a respective prize progression affecting element comprising a progress varying value, and under the control of the at least one processor, modifying the prize progression graphic displayed on the display device by modifying the respective set of progression segments for one or more prize progressions to indicate a different level of progress along the respective set of progression segments toward the prize included for the respective prize progression;

(d) in response to a selection of a respective object corresponding to a respective prize progression affecting element comprising a prize shifting value, and under the control of the at least one processor, modifying the prize progression graphic displayed on the display device by shifting at least one respective prize from being included with one prize progression to being included with another one of the prize progressions; and (e) awarding to the player the respective prize included with each prize progression for which progress in the respective progression segments is completed on a given selection of one of the objects, the respective prize being awarded through the gaming machine.

2. The method of claim 1 wherein each object conceals the corresponding prize progression affecting element and further including revealing the respective prize progression affecting element on the display device or additional display device in response to the selection of the corresponding object.

3. The method of claim 1 wherein each prize progression also includes a respective prize level symbol and further including, in response to the selection of a respective object corresponding to a respective prize progression affecting element comprising a prize level symbol shifting value, modifying the prize progression graphic displayed on the display device by shifting at least one respective prize level symbol from being included with one prize progression to being included with a different one of the prize progressions.

4. The method of claim 3 wherein at least one of the prize level symbols includes a prize enhancer symbol and further including applying the prize enhancer symbol to increase a respective one of the prizes awarded to the player.

5. The method of claim 3 further including changing a respective prize level symbol that has been shifted to a respective different one of the prize progressions displayed on the display device so as to correspond with the relative value of the prize included with that prize progression.

6. The method of claim 1 wherein the selection of a respective object is made in response to a player selection of a particular object displayed on the display device or the additional display device of the gaming machine.

7. The method of claim 1 wherein the selection of a respective object is made on behalf of the player without a player selection of a particular object displayed on the display device or the additional display device of the gaming machine.

8. The method of claim 1 wherein the number of objects displayed at the gaming machine are displayed concurrently and the selection of a respective object is from the number of concurrently displayed objects.

9. The method of claim 1 wherein a first one of the number of objects and a second one of the number of objects are displayed at the gaming machine at different points in time.

10. An apparatus including:

(a) a display arrangement for a player;

(b) a player input device for the player;

(c) a presentation controller for (i) causing the display arrangement to display a prize progression graphic, the prize progression graphic including a number of prize progressions with each respective prize progression including a respective prize and a respective set of progression segments, for (ii) causing the display arrangement to display a number of objects, each object corresponding to a respective prize progression affecting element, for (iii) responsive to a selection of a respective object corresponding to a prize progression affecting element comprising a progress varying value, causing the display arrangement to modify the prize progression graphic by modifying the respective set of progression segments for one or more prize progressions to indicate a different level of progress along the respective set of progression segments toward the prize included for the respective prize progression, and for (iv) responsive to a selection of a respective object corresponding to a prize progression affecting element comprising a prize shifting value, causing the display arrangement to modify the prize progression graphic by shifting at least one respective prize from being included with one prize progression to being included with another one of the prize progressions; and (d) an award controller for awarding to the player the respective prize included with each prize progression for which progress in the respective progression segments is completed on a given selection of one of the objects.

11. The apparatus of claim 10 wherein each object conceals the corresponding prize progression affecting element and wherein the presentation controller is also for causing the display arrangement to reveal the respective prize progression affecting element in response to the selection of the corresponding object.

12. The apparatus of claim 10 wherein each prize progression also includes a respective prize level symbol and wherein the presentation controller is also for, in response to the selection of a respective object corresponding to a respective prize progression affecting element comprising a prize level symbol shifting value, causing the display arrangement to modify the prize progression graphic by shifting at least one respective prize level symbol from being included with one prize progression to being included with a different one of the prize progressions.

13. The apparatus of claim 12 wherein at least one of the prize level symbols includes a prize enhancer symbol and wherein the award controller is also for applying the prize enhancer to increase a respective one of the prizes awarded to the player.

14. The apparatus of claim 13 wherein the presentation controller is also for causing the display arrangement to change a respective prize level symbol that has been shifted to a different one of the prize progressions to correspond with the prize included with that prize progression.

15. The apparatus of claim 10 wherein the selection of a respective object is made in response to a player selection of a particular object displayed at the display arrangement, the player selection being entered through the player input device for the player.

16. The apparatus of claim 10 wherein the display arrangement displays the number of objects concurrently and the selection of a respective object is from the number of concurrently displayed objects.

17. A program product embodied in one or more non-transitory computer readable media, the program product including:

(a) prize progression display program code executable for causing a gaming machine display arrangement to display a prize progression graphic, the prize progression graphic including a number of prize progressions with each respective prize progression including a respective prize and a respective set of progression segments;

(b) object display program code executable for causing the gaming machine display arrangement to display a number of objects at the gaming machine, each object corresponding to a respective prize progression affecting element;

(c) selection program code executable for selecting a number of the objects, and in response to the selection of a respective object corresponding to a progress varying value, causing the gaming machine display arrangement to modify the prize progression graphic by modifying the respective progression segments for one or more prize progressions to indicate a different level of progress along the respective set of progression segments toward the prize included for the respective prize progression, and in response to the selection of a respective object corresponding to a prize shifting value, causing the gaming machine display arrangement to modify the prize progression graphic by shifting at least one respective prize from being included with one prize progression to being included with a different one of the prize progressions; and (d) award program code executable for awarding the respective prize included with each prize progression for which progress in the respective progression segments is completed on a given selection of one of the objects.

18. The program product of claim 17 wherein each object conceals the corresponding prize progression affecting element and wherein the selection program code is also executable to cause the gaming machine display arrangement to reveal the respective prize progression affecting element in response to the selection of the corresponding object.

19. The program product of claim 17 wherein each prize progression also includes a respective prize level symbol and wherein the selection program code is also executable for, in response to the selection of a respective object corresponding to a respective prize progression affecting element comprising a prize level symbol shifting value, causing the gaming machine display arrangement to modify the prize progression graphic by shifting at least one respective prize level symbol from being included with one prize progression to being included with a different one of the prize progressions.

20. The program product of claim 19 wherein at least one of the prize level symbols includes a prize enhancer symbol and wherein the award program code is also executable for applying the prize enhancer to increase a respective one of the awarded prizes.

21. The program product of claim 17 wherein the selection program code is executable to select a respective object in response to a player selection of a particular object displayed at the gaming machine display arrangement, the player selection being entered through a player input device.

22. The program product of claim 17 wherein the object display program code is executable for causing the gaming machine display arrangement to display the number of objects concurrently and wherein the selection of a respective object is from the number of concurrently displayed objects.

* * * * *